US006939273B2

(12) United States Patent
Zajac et al.

(10) Patent No.: US 6,939,273 B2
(45) Date of Patent: Sep. 6, 2005

(54) HOCKEY WEIGHT TRAINING DEVICE

(76) Inventors: Daniel P. Zajac, 776 Ayers St., Bolingbrook, IL (US) 60440; Rosemary J. Zajac, 776 Ayers St., Bolingbrook, IL (US) 60440; Larry Pedrie, 103 Forestview La., Aurora, IL (US) 60504; Jody L. Pedrie, 103 Forestview La., Aurora, IL (US) 60504

( * ) Notice: Subject to any disclaimer, the term of this patent is extended or adjusted under 35 U.S.C. 154(b) by 111 days.

(21) Appl. No.: 10/334,169

(22) Filed: Jan. 2, 2003

(65) Prior Publication Data

US 2004/0132589 A1 Jul. 8, 2004

(51) Int. Cl.[7] ..... A63B 59/14; A63B 69/00

(52) U.S. Cl. ..... 482/93; 482/109; 482/44; 473/437; 473/563

(58) Field of Search ..... 482/44, 79, 92, 482/93, 105, 109; 473/256, 437, 519, 553, 560–563

(56) References Cited

U.S. PATENT DOCUMENTS

| | | | | | |
|---|---|---|---|---|---|
| 3,278,184 | A | | 10/1966 | Rosenbaum | |
| 3,306,610 | A | * | 2/1967 | Biggs, Jr. et al | 482/105 |
| 3,834,697 | A | | 9/1974 | McNamara | |
| 3,924,851 | A | * | 12/1975 | Winston | 482/105 |
| 4,000,893 | A | * | 1/1977 | Evans | 473/437 |
| 4,052,061 | A | | 10/1977 | Stewart | |
| 4,364,560 | A | | 12/1982 | Gemmel | |
| 4,538,812 | A | | 9/1985 | Mugford et al. | |
| 4,838,546 | A | * | 6/1989 | Winston | 482/105 |
| 4,923,418 | A | * | 5/1990 | Hoffman | 441/57 |
| 4,958,386 | A | * | 9/1990 | Louis-Jeune | 2/227 |
| 4,997,183 | A | * | 3/1991 | Winston | 482/105 |
| 5,076,575 | A | * | 12/1991 | Eylander | 482/105 |
| 5,127,891 | A | * | 7/1992 | Winston | 482/50 |
| 5,484,156 | A | * | 1/1996 | Giguere | 473/256 |
| 5,607,378 | A | * | 3/1997 | Winston | 482/105 |
| 6,007,461 | A | * | 12/1999 | Winston | 482/55 |
| 2003/0130070 | A1 | * | 7/2003 | Nolan | 473/437 |

OTHER PUBLICATIONS

Trigger Weight Performance Trainer, Sweatsport Co., Inc., product packaging, date unknown.*

* cited by examiner

*Primary Examiner*—Jerome W. Donnelly
*Assistant Examiner*—Victor K. Hwang
(74) *Attorney, Agent, or Firm*—James D. Palmatier

(57) ABSTRACT

The weight training device 10 has removable weights 40, 42, 44, 46 to change the total weight added to the hockey stick 66 to adapt to the skills and capabilities of a player. Pockets 32, 34, 36, 38 are formed in the weight training device 10 to hold the weights 40, 42, 44,46 along the rectangular sides 75, 77 of the hockey stick 66. A compressible membrane flap 48 is attached to retain the weights 40, 42, 44, 46 in the pockets 32, 34, 36, 38 and to provide some adhesion to the hockey stick 66 3to prevent the device 10 from moving on the hockey stick 66.

20 Claims, 3 Drawing Sheets

HOCKEY WEIGHT TRAINING DEVICE

CROSS-REFERENCE TO RELATED APPLICATIONS

N/A

STATEMENT REGARDING FEDERALLY SPONSORED RESEARCH OR DEVELOPMENT

N/A

REFERENCE TO A SEQUENCE LISTING, A TABLE, OR A COMPUTER PROGRAM LISTING

N/A

COMPACT DISC APPENDIX

N/A

FIELD OF THE INVENTION

This invention relates to weight training devices for athletes including but not limited to hockey players.

BACKGROUND OF THE INVENTION

Hockey players play on a hard surface usually ice, concrete or in a field. A hockey stick is used to control, shoot and pass a puck in ice hockey. The hockey stick is gripped by the player usually with both hands. The hockey player, by flexing arms and bending wrists moves and controls the puck. The strength of the arms is important to the control of the puck. Strong arms and wrists can project the puck off of the stick with greater velocity making shots harder to stop and passes harder to intercept.

Strengthening the arms of a hockey layer is traditionally done by practice or by weight training. Practice can be physically exhausting to the player's body while only providing small increases in arm strength. Weight training is good for overall strength however, the specific muscles used to control the hockey stick while handling the puck are hard to isolate.

Hockey players come in all sizes and skill levels. A training device needs to be able to accommodate different skill levels with minimum difficulty. Adding a weight to the hockey stick would provide a weight training experience focused on the specific muscles used to handle, pass and shoot a puck.

Attaching weights to the hockey stick may result in damaging the shaft of the hockey stick by the fasteners or the weight itself. An example of this method is found in U.S. Pat. No. 4,364,560('560). The integrity of the shaft is compromised by the thumbscrew used to tighten against the shaft to hold the weight in place.

Furthermore, the weight needs to change for different skill and strength levels. As the hockey player develops, more weight is used to continue to strengthen the arms. When used for injury recovery, the weight should be minimal and be able to easily be modified to increase the strengthening effect as the player recovers. The '560 patent and U.S. Pat. No. 3,834,697 both illustrate a single weight added to the shaft. Additional weights are not easily added and the incremental weight may be too great for some developing hockey players.

Accordingly, there is a need for a device that can be easily added to and removed from a hockey stick shaft, having a capability to ass or subtract weights to customize the weight for the hockey player.

SUMMARY

The invention provides a simple and convenient means for attaching weights to the shaft of a hockey stick while easily changing the weight in the invention to benefit a specific hockey player.

A flexible device is formed having one or more pockets and a fastening means to attach the device to the hockey stick. In the preferred embodiment, the device is attached at the bottom of the shaft adjacent where the shaft and the blade intersect. The device has a plurality of pockets and a flap of a compressible material to absorb shocks.

One or more weights are removably disposed in the pockets to provide a specific amount of weight for the player. A flap is positioned to fold over the open end of the pockets to retain the weights in the pockets. A layer of compressible material is positioned adjacent the shaft and is compressed by the fastening means securing the device to the hockey players.

When the player wants to remove the invention to increase the weight, play a game or give it to another player, the fastener is undone and the invention is easily removed. Additional weights may be added when the invention is not on the shaft. Weights may also be removed and/or replaced with weights of a different weight.

DETAILED DESCRIPTION OF THE INVENTION

The following describes a removable weight-training device for mounting on a hockey stick or similar athletic implement. The weight training device has removable weights to change the total weight added to the hockey stick to adapt tot the skills and capabilities of the player. Pockets are formed in the weight-training device to hold the weights along the rectangular sides of the hockey stick. A compressible membrane flap is attached to retain the weights in the pockets and to provide some adhesion to the hockey stick to prevent the device from moving on the stick.

Figure 1:
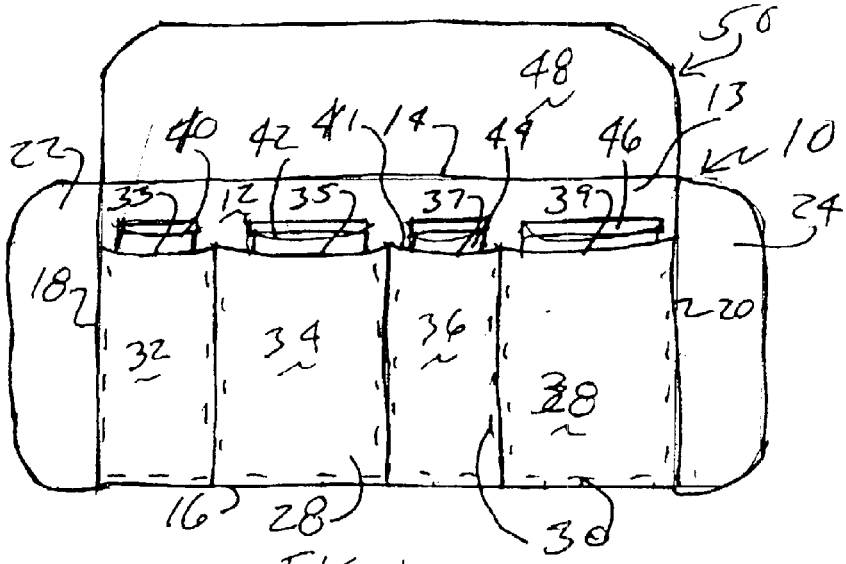
FIG. 1 is a side plane view showing the flap up and weights in the pockets.

Referring now to the drawings, FIG. 1 illustrates a preferred embodiment of the removable weight training device 10 comprising a weight carrier 12 having an outer layer 13 comprising a tear proof and water resistant material. The outer layer 13 comprises a top edge 14 a bottom edge 16, a first end 18 and a second end 20. A first fastener 22 is attached to the first end 18 and a second fastener 24 is attached to the second end 20. An inner layer 28 is attached to the outer layer 13 with stitching 30. The inner layer 28 is preferably made from a rip resistant material. The stitching 30 extends around the first end 18 along the bottom edge 16 and along the second end 20 attaching the inner layer 28 to the outer layer 13. Additional stitching 30 is extends up from the bottom edge 16 to define a plurality of pockets 32, 34, 26, 38.

The first pocket 32 is defined adjacent the first end 18. The first pocket 32 has a first pocket opening 33 adjacent the top edge 14. The first pocket opening 33 may be formed by an opening 33 in the inner layer 28 or by the opening between the inner layer top edge 41 and the outer layer 13. A first weight 40 is removably disposed in the first pocket 32 by inserting the weight in the first pocket opening 33.

A second pocket 34 is formed intermediate the first pocket 32 and the second end 20. The second pocket 34 has a second pocket opening 35 adjacent the top edge 14. The second pocket opening 35 may be formed by an opening 35 in the inner layer 28 or by an opening between the inner layer top edge 41 and the outer layer 13. A second weight 42 is removably disposed in the second pocket 34 by inserting the second weight 42 in the second pocket opening 35.

A third pocket 36 is defined intermediate the second pocket 34 and the second end 20. The third pocket 36 has a third pocket opening 37 adjacent the top edge 14. The third pocket opening 37 may be formed by an opening 37 in the inner layer 28 or by an opening 37 between the inner layer top edge 41 and the outer layer 13. A third weight 44 is removably disposed in the third pocket 36 by inserting the third weight 44 in the third pocket opening 37.

A fourth pocket 38 is defined intermediate the third pocket 36 and the second end 20. The fourth pocket 38 has a fourth pocket opening 39 adjacent the top edge 14. The fourth pocket opening 39 may be formed by an opening 39 in the inner layer 28 or by an opening between the inner layer top edge 41 and the outer layer 13. A fourth weight 46 is removably disposed in the fourth pocket 38 by inserting the fourth weight 46 in the fourth pocket opening 39.

A flap 48 is attached to the outer layer 13 along the top edge 14. The flap 48 is shown in the open position 50 extending from the weight carrier 12. In the preferred embodiment the flap 48 is formed from a compressible membrane to cushion the attachment of the weight carrier 12 to the hockey stick and provide some flexing to allow the first and second fasteners 22, 24 to securely hold the weight carrier 12 in place. The flap 48 made from a compressible membrane may also provide a surface on the hockey stick to resist sliding out of position.

Figure 2:
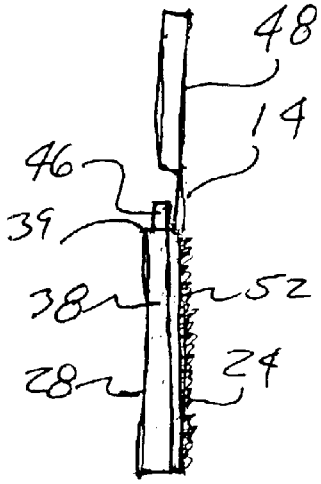
FIG. 2. Is an end view of the invention of FIG. 1.

An end perspective is shown in FIG. 2. The flap 48 is shown in the open position 50. The second fastener 24 is illustrated as a loop material 52. The fourth weight 46 is put in the fourth pocket 38 by inserting through the fourth pocket opening 39.

Figure 3:
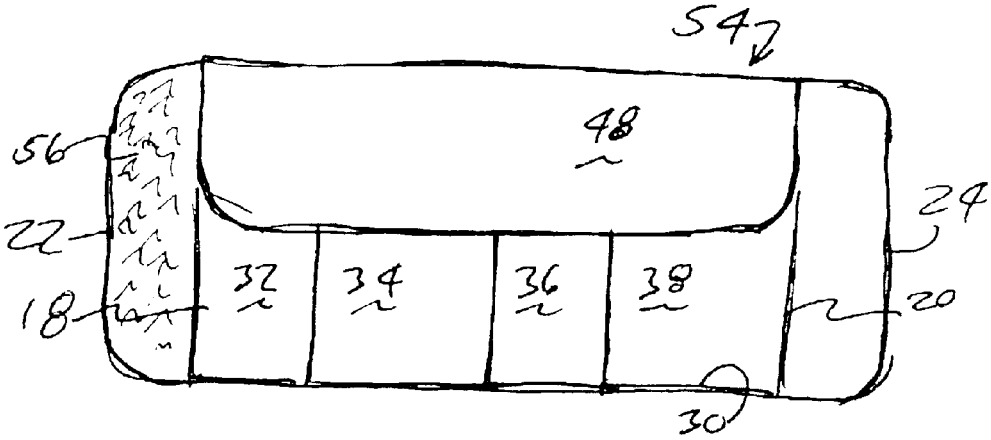
FIG. 3. Is a side plan view of the invention showing the flap in the closed position.

The flap 48 is shown in the closed position 54 in FIG. 3. The flap 48 retains the weights in the respective pockets. First fastener 22 is illustrated as a hook material 56 on the first end. The hook material 56 mates with the loop material 52 on the second end 20 to secure the weight carrier 12 in place. The hook material 56 and the loop material 52 may be a Velcro or similar hook and loop fastening material.

Figure 4:
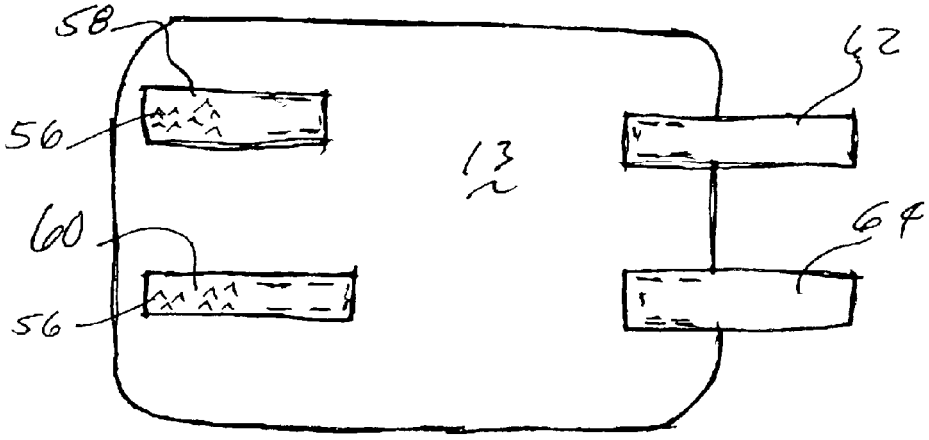
FIG. 4. Is a side plan view of an alternative embodiment.

The first fastener 22 is shown as first strap 58 and second strap 60 on first end 18 in FIG. 4. The outer layer 13 supports and is attached to the first and second strap 58, 60 by stitching 30. Second fastener 24 is shown as third strap 62 and fourth strap 64 on outer layer 13. Third and fourth strap are attached to second end 20 by stitching 30 on outer layer 13.

Figure 5:
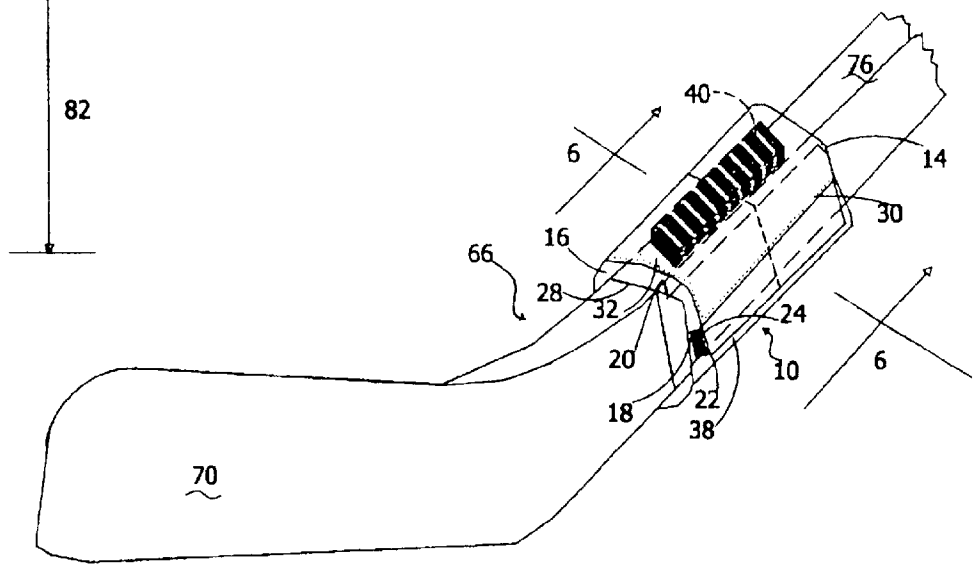
FIG. 5. Is a perspective view of the invention mounted on a hockey stick.

The removable weight-training device 10 is shown attached to a hockey stick 66 in FIG. 5 the hockey stick 66 has a shaft 68 and a blade 70. The preferred location for attaching the weight carrier 12 is on the shaft 68 adjacent the blade 70. This position does not interfere with the handling of the puck and provides the advantage of the length of the stick 66 to strengthen the player. The first fastener 22 may be configured with a buckle or other fastener mechanism on the first and second 58, 60 straps. The weight 40 is shown having a rectangular shape and a rectangular cross section. The weight 40 is aligned with the shaft 68 having a flat side on the top 76.

Figure 6:
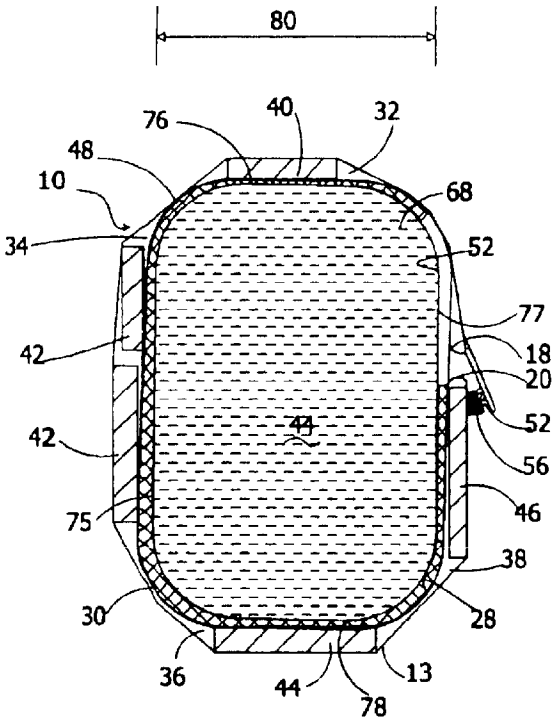
FIG. 6 is a cross section view of the device mounted on the hockey stick.

The substantially rectangular cross-section 76 of the shaft 68 is shown in FIG. 6. The stick 68 can be seen to have a first side 75 and a second side 77 each having a similar first width 80. Likewise, the top 76 and bottom 78 of the shaft 68 have a similar second width 82 in the preferred embodiment the pockets 32, 34, 36, 38 will have a width of similar dimensions with the adjoining edge of the hockey stick shaft 68. For example as illustrated in FIG. 6, the first pocket 32 and the third pocket 36 will have a width substantially similar to the second width 82 and the second pocket 34 and the fourth pocket 38 will have a width substantially similar to the first width 80. The weights 40, 42, 44, 46 are shown having a flat side adjacent to the respective side of the shaft 68.

The flap 48 made of a compressible membrane is shown in FIG. 6 as compressed by tightly bringing the first fastener 22 in a mating position with the second fastener 24.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. In combination with a hockey stick, the hockey stick having a handle, the handle having a rectangular cross section with two sides having a first width and top and bottom sides having a second width, the second width less than the first width;

a removable weight training device, the weight training device comprising a weight carrier having four weight pockets, a flap, a first fastener, a second fastener and a first weight, the first fastener to bear against the handle, each of the four weight pockets having an opening, the flap on the weight training device adjacent the openings, each of the four weight pockets positioned adjacent to each other, each one of the four weight pockets positioned to bear against one of the four sides of the rectangular handle with first and third pockets each having a width substantially equal to the second width of the handle and second and fourth weight pockets each having a width substantially equal to the first width, the second fastener engaging the first fastener to attach the weight training device to the handle such that each of the four sides of the rectangular handle has a weight pocket thereon, the first weight removably disposed on one of the four weight pockets.

2. The combination of claim 1 wherein the flap is movable from an open position to a closed position over the openings on the pockets.

3. The combination of claim 1 wherein the weight carrier further comprises a compressible membrane attached between the first fastener and the second fastener wherein the compressible membrane is between the weight pockets and the handle.

4. The combination of claim 1 wherein the first fastener comprises a releasable hook material and the second fastener comprises a loop material for mating with the releasable hook material to secure weight carrier to the handle.

5. The combination of claim 1 wherein the weight carrier comprises an outer layer, an inner layer, a top edge and a bottom edge, stitching on the weight carrier along the top edge to hold the outer layer to the inner layer, material removed from the inner layer to form an opening in one of the four weight pockets.

6. The combination of claim 1 further comprising a second weight in a second of the four weight pockets, the second weight held adjacent a second of the four sides of the handle.

7. The combination of claim 6 further comprising a third weight in a third of the four weight pockets, the third weight held adjacent a third of the four sides of the handle by the first and second fasteners.

8. The combination of claim 7 further comprising a fourth weight in a fourth of the four weight pockets, the fourth weight held adjacent a fourth of the four sides of the handle wherein a weight pocket is held adjacent each of the four sides of the handle, one weight in the weight carrier is held adjacent each of the four sides of the handle.

9. The combination of claim 1 wherein the flexible weight carrier comprises an outer layer and an inner layer, the inner layer attached to the outer layer to form the pockets between the inner layer and the outer layer, an opening on the first pocket formed in the inner layer.

10. The combination of claim 9 wherein the flap extends comprises a compressible material, the compressible material on the handle when the first fastener is attached to the second fastener.

11. The combination of claim 10 further comprising a three additional weights, an opening in the inner layer extending to each of the four weight pockets, the flap over the opening in the inner layer, a weight in each pocket wherein the weight carrier holds a weight adjacent each of the four sides of the handle.

12. A weight training device comprising:

a hockey stick, the hockey stick having a shaft and a blade, the shaft having a rectangular cross section with two sides, each of the two sides having a first width, and a top and a bottom, the top and the bottom each having a second width, the second width less than the first width; and a weight carrier having an inner layer, a first fastener, a second fastener, a first pocket having a width substantially equal to the first width and a second pocket, the second pocket having a width substantially equal to the second width, the weight carrier wrapped around the shaft having the inner layer on the shaft, the first pocket adjacent the one of the two sides, the second pocket adjacent one of the top or bottom sides, the first fastener removably fastened to the second fastener, a weight in the first pocket.

13. The weight training device of claim 12 further comprising an outer layer, stitching on the outer layer and inner layer attaching the outer layer to the inner layer, the first pocket and the second, a second weight having a side in the second pocket, the side of the second weight held parallel to a one of the two sides of the shaft.

14. The weight training device of claim 13 further comprising a third pocket having a width substantially equal to the first width and a fourth pocket having a width substantially equal to the second width, a third weight in the third pocket, a fourth weight in the fourth pocket wherein the third weight is adjacent the other of the two sides of the shaft, the fourth weight held adjacent the bottom side of the shaft, the first fastener intermediate the second fastener and the shaft.

15. A hockey stick for weight training comprising:

a shaft having a blade attached, the shaft having four sides and a rectangular cross section; and a weight carrier removably attached on the shaft, the weight carrier adjacent the blade, the weight carrier having a bottom edge adjacent the blade and a top edge, a flap on the top edge, a plurality of pockets in the weight carrier, a first weight in one of the plurality of pockets, the flap movable to retain the first weight in the weight carrier, the first weight adjacent only one of the four sides of the shaft.

16. The weight carrier of claim 15 further comprising a third pocket formed adjacent the second pocket, the third pocket having an open end adjacent the top edge, a third weight removably disposed in the third pocket.

17. The invention of claim 15 further comprising a compressible membrane on the weight carrier, the compressible membrane intermediate the first weight and the shaft.

18. A training device comprising:

a hockey stick having a shaft and a blade, the shaft on the blade, the shaft having a top, a bottom, a first side and a second side, the shaft having a rectangular cross section with the two sides having a first width and the top and bottom sides having a second width less than the first width;

a weight carrier removably wrapped on the shaft, the weight carrier having a first weight pocket, a second weight pocket, a third weight pocket, a fourth weight pocket, a flap, a first fastener and a second fastener, an opening in the first pocket, a first weight in the first pocket, the flap covering the opening in the first pocket, the first weight aligned with and adjacent to the first side, the second weight pocket aligned with and adjacent to the top, the third weight pocket aligned with and adjacent to the second side, the fourth weight pocket aligned with and adjacent to the bottom of the shaft wherein the first and third weight pockets each have a width substantially equal to the first width and the second and fourth weight pockets each have a width substantially equal to the second width, the first fastener removably attached to the second fastener whereby the weight carrier is held wrapped around the shaft.

19. The invention of claim 18 further comprising a compressible membrane on the weight carrier, the compressible membrane bearing against the shaft.

20. The invention of claim 19 further comprising a second weight, a third weight and a fourth weight, the first weight further comprising a flat side adjacent to the first side of the shaft, the second weight in the second weight pocket, the second weight having a flat side adjacent the top, the third weight in the third pocket, the third weight having a flat side adjacent to the second side, the fourth weight removably in the fourth weight pocket, the fourth weight adjacent to the bottom.

* * * * *